US007527272B2

(12) United States Patent
Frauhammer et al.

(10) Patent No.: US 7,527,272 B2
(45) Date of Patent: May 5, 2009

(54) CHUCK

(75) Inventors: Karl Frauhammer, Leinfelden-Echterdingen (DE); Manfred Hellbach, Leinfelden-Echterdingen (DE); Heinz Schnerring, Dettenhausen (DE); Joerg Friedrich, Penang (MY); Andreas Strasser, Rudersberg (DE); Michael Mayer, Leinfelden-Echterdingen (DE); Werner Huser, Leinfelden-Echterdingen (DE)

(73) Assignee: Robert Bosch GmbH, Stuttgart (DE)

( * ) Notice: Subject to any disclaimer, the term of this patent is extended or adjusted under 35 U.S.C. 154(b) by 375 days.

(21) Appl. No.: 11/446,431

(22) Filed: Jun. 2, 2006

(65) Prior Publication Data

US 2007/0040339 A1 Feb. 22, 2007

(51) Int. Cl.
*B25D 17/08* (2006.01)

(52) U.S. Cl. ..... 279/19; 279/82; 279/140; 279/904

(58) Field of Classification Search ..... 279/19, 279/75, 76, 82, 140, 904, 905; *B25D 17/08*
See application file for complete search history.

(56) References Cited

U.S. PATENT DOCUMENTS

| | | | | |
|---|---|---|---|---|
| 4,898,250 | A | 2/1990 | Plank et al. | |
| 5,111,890 | A * | 5/1992 | Ranger et al. | 173/104 |
| 5,709,391 | A | 1/1998 | Arakawa et al. | |
| 5,971,403 | A * | 10/1999 | Yahagi et al. | 279/19.3 |
| 6,179,300 | B1 * | 1/2001 | Baumann et al. | 279/19.4 |
| 6,464,234 | B2 * | 10/2002 | Frauhammer et al. | 279/19.4 |
| 6,527,280 | B2 * | 3/2003 | Frauhammer et al. | 279/19.5 |
| 6,923,271 | B2 * | 8/2005 | Frauhammer et al. | 173/132 |
| 7,137,457 | B2 * | 11/2006 | Frauhammer et al. | 173/29 |
| 7,214,010 | B2 * | 5/2007 | Hellbach et al. | 408/240 |
| 7,258,349 | B2 * | 8/2007 | Frauhammer et al. | 279/19 |
| 2001/0008186 | A1 * | 7/2001 | Frauhammer et al. | 173/90 |
| 2001/0013682 | A1 * | 8/2001 | Frauhammer et al. | 279/19.4 |
| 2007/0096404 | A1 * | 5/2007 | Frauhammer et al. | 279/19.4 |
| 2007/0120331 | A1 * | 5/2007 | Manschitz et al. | 279/19 |

FOREIGN PATENT DOCUMENTS

| | | |
|---|---|---|
| DE | 34 21 811 | 12/1985 |
| DE | 36 38 215 | 5/1988 |
| DE | 19950393 A1 * | 5/2001 |
| DE | 100 26 021 | 11/2001 |

* cited by examiner

*Primary Examiner*—David P Bryant
*Assistant Examiner*—Eric A. Gates
(74) *Attorney, Agent, or Firm*—Kenyon & Kenyon LLP

(57) ABSTRACT

A chuck is described, in particular for a hammer drill or chisel hammer, having a chuck body having an insertion opening for holding a tool shank, and a locking element for axially locking the tool shank in the insertion opening, the locking element being movable between a locked position and an unlocked position, and having an arresting pin, mounted in the locking element and radially displaceable between an arresting position and a release position, which axially arrests the locking element in its arresting position and axially releases it in its release position.

18 Claims, 3 Drawing Sheets

CHUCK

FIELD OF THE INVENTION

The present invention is directed to a chuck.

BACKGROUND INFORMATION

A chuck for a boring tool, which allows one-handed operation when changing the tool, is known from German Published Patent Application No. 100 26 021. For this purpose, the chuck has a chuck body having an insertion opening, into which a tool shank may be axially inserted. In the inserted state, the tool shank may be axially locked by locking bodies, the locking bodies engaging in axially running grooves in the tool shank, so that the tool shank has a specific movement play in the axial direction in the locked state. For this purpose, radial yielding movement of the locking bodies is prevented by an axially displaceable locking sleeve when the locking sleeve is in a locked position. In contrast, when the locking sleeve is pushed into an unlocked position by the operator, the locking bodies may yield radially outward and the boring tool may be removed from the chuck or inserted into the chuck. The locking sleeve is pre-tensioned in the direction of the locked position by a spring in this case, in order to prevent unintentional unlocking of the boring tool. To allow one-handed operation, however, the locking sleeve may be axially arrested in the unlocked position, the arresting being performed by a leaf spring, for example, which engages in the locking sleeve from the inside.

SUMMARY OF THE INVENTION

In contrast, the present invention provides a chuck in which the mechanism for arresting the locking sleeve is simple and robust.

For this purpose, an arresting pin, which is displaceable in the radial direction in relation to the insertion opening between an arresting position and a release position, is mounted in the preferably sleeve-shaped locking element.

In the arresting position of the arresting pin, the locking element is arrested in the unlocked position, so that the tool shank may be inserted into the chuck or removed from the chuck without the user having to hold the locking element at the same time.

In contrast, in the release position of the arresting pin, the locking element is not arrested in the unlocked position, as the result of which the tool shank is axially locked in the chuck.

In a preferred embodiment of the present invention, a spring element is provided which pre-tensions the arresting pin in the direction of the arresting position, the arresting pin pressing against an axial stop in the chuck body in the arresting position. The arresting pin then preferably slides automatically into the arresting position because of the spring pre-tension when the user moves the locking element out of the locked position into the unlocked position. Therefore, no user intervention is necessary to arrest the locking element in the unlocked position in this case, which significantly simplifies operation.

The arresting of the locking element may preferably also be disengaged without user intervention in order to further simplify operation. In a preferred embodiment, the arresting pin may therefore be disengaged from the arresting position by the tool shank. This disengagement of the arresting preferably occurs in that the movement of the tool shank when being removed from the chuck and/or when being inserted into the chuck is transmitted to the arresting pin and thus disengages it from the arresting position.

For this purpose, a preferably spherical transmission element may be provided for transmitting force from the tool shank to the arresting pin, for example, this transmission element projecting radially into the insertion opening of the chuck and being displaced radially outward when the tool shank is inserted or removed and pressing the arresting pin radially outward at the same time.

The transmission element is preferably a ball which is mounted in an opening in the chuck body so it is radially displaceable. For this purpose, the opening preferably tapers conically inward in order to prevent the ball from falling out on the inside when there is no tool shank in the chuck.

The concept of a locking element used in the scope of the present invention is to be understood generally and is not restricted to the locking sleeve described at the beginning, which encloses the chuck body like a sheath and is axially displaceable.

A spring element is preferably provided which pre-tensions the locking element in the direction of the locked position in order to prevent unintended unlocking of the tool shank.

The locking element may be displaced, for example, as in the known chuck described at the beginning, in that the user directly operates the locking element.

However, in a preferred embodiment, a separate operating element is provided which is preferably implemented as an operating sleeve and advantageously encloses the locking element like a sheath. The operating element is preferably axially displaceable and pre-tensioned by a spring element in the axial direction in order to define a neutral position. A movement of the operating element may be transmitted to the locking element, which may occur, for example, in that the operating element drives the locking element. However, it is also alternatively possible that the operating element is coupled rigidly or elastically to the locking element in order to transmit the movement of the operating element to the locking element.

The tool shank may actually be locked in the chuck, as in the known chuck described at the beginning, by locking bodies which engage in corresponding grooves in the tool shank. However, radially displaceable locking rollers, which are significantly more wear-resistant, are preferably used to lock the tool shank.

Furthermore, the present invention also relates to a machine tool, such as a hammer drill or a chisel hammer, having a chuck according to the present invention.

DETAILED DESCRIPTION

Figure 1:
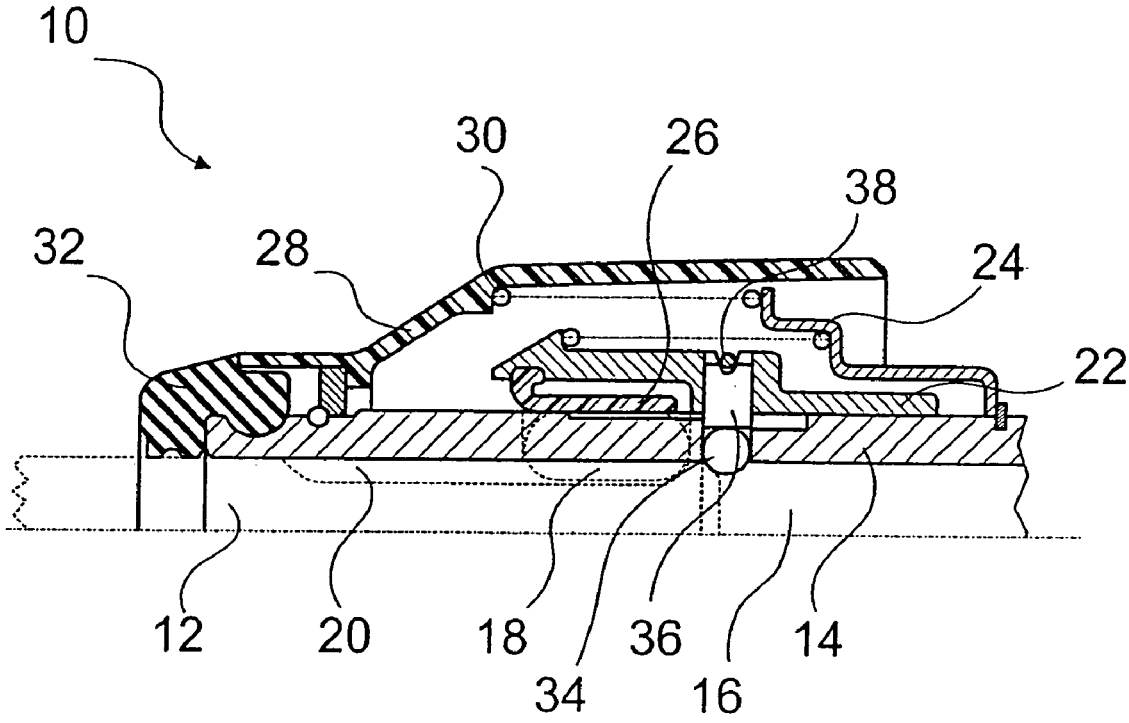
FIG. 1 shows a cross-sectional view of a chuck according to the present invention in the unlocked position as a tool shank is being inserted.
Figure 2:
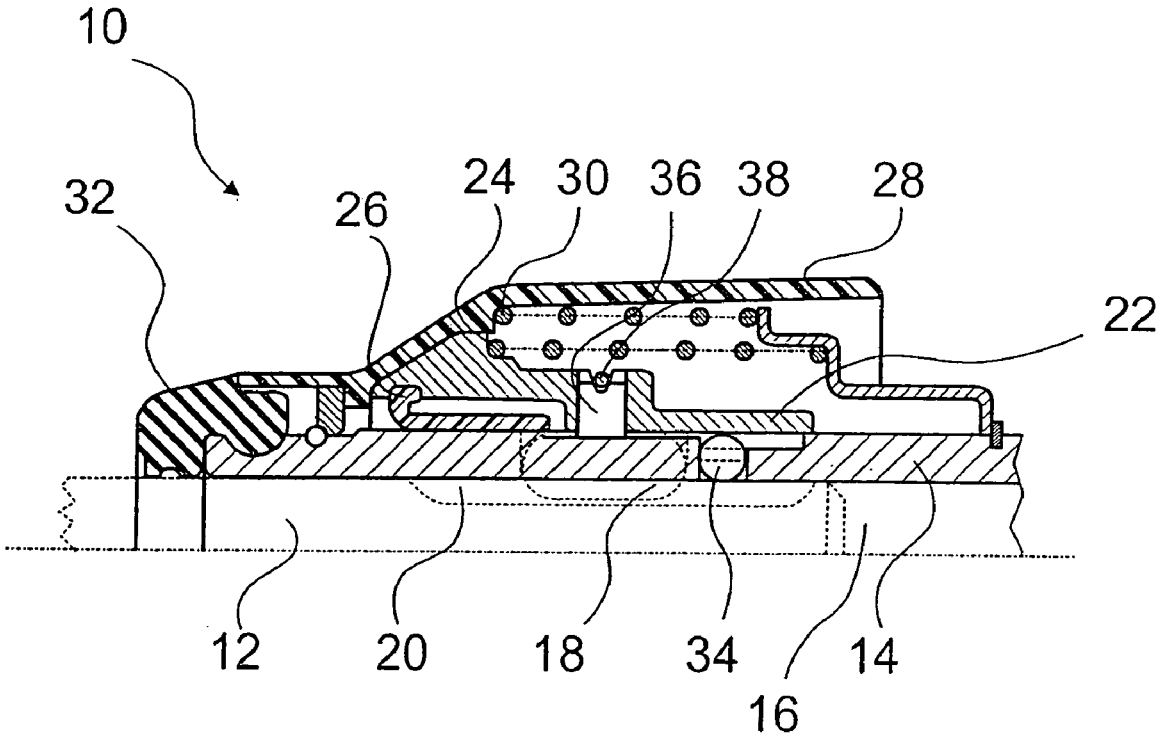
FIG. 2 shows a cross-sectional view of the chuck from FIG. 1 in the locked position with a tool shank inserted.
Figure 3:
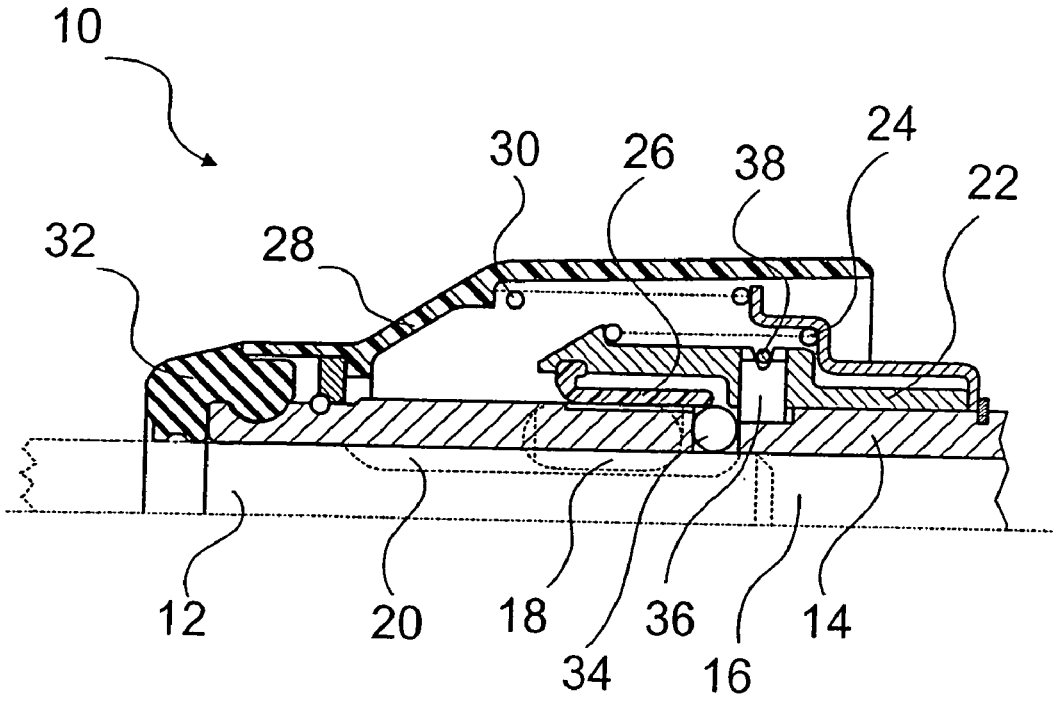
FIG. 3 shows a cross-sectional view of the chuck from FIG. 1 in the unlocked position as the tool shank is being removed.
Figure 4A:
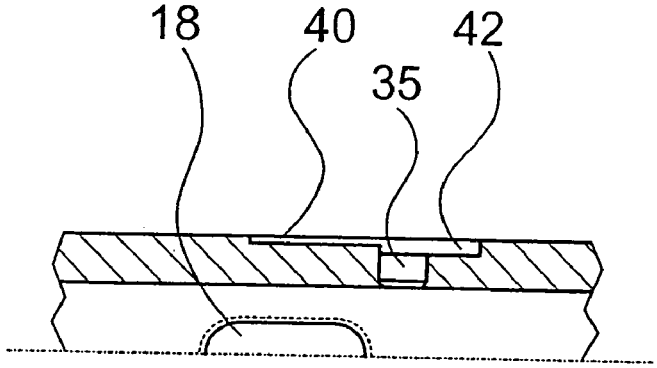
FIG. 4*a* shows a detailed view of the chuck from FIG. 1 in cross section.
Figure 4B:
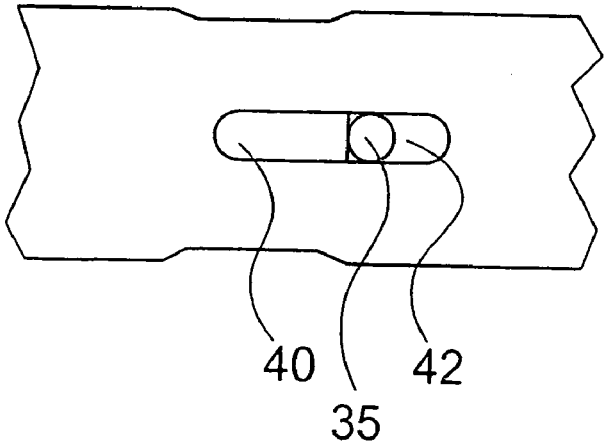
FIG. 4*b* shows the detailed view from FIG. 4*a* in a radial top view.

The cross-sectional views in FIGS. 1 through 3 show a chuck 10 for a hammer drill or a chisel hammer, chuck 10 allowing axial locking of a tool shank 12 with a predefined axial movement play and simple one-handed operation when changing tools.

For this purpose, the chuck has an essentially hollow-cylindrical chuck body 14 having an insertion opening 16, into which tool shank 12 may be axially inserted.

Multiple openings are provided distributed around the circumference in chuck body 14, in each of which a locking roller 18 is positioned, the openings tapering inward in the radial direction in order to prevent locking rollers 18 from being able to fall out on the inside.

Locking rollers 18 may engage in an axially running groove 20 in the lateral surface of tool shank 12 to axially lock tool shank 12, through which tool shank 12 is locked with a predefined axial movement play.

Furthermore, chuck 10 has a locking sleeve 22 which is axially displaceable between the locked position shown in FIG. 2 and the unlocked position shown in FIG. 1.

In the locked position shown in FIG. 2, locking sleeve 22 covers the openings in chuck body 14 and thus prevents a radial yielding motion of locking rollers 18, through which removal of tool shank 12 is prevented.

In the unlocked position shown in FIGS. 1 and 3, in contrast, the openings in chuck body 14 are covered by an elastic lip-type ring 26, which is attached to the inside of a stepped expansion of locking sleeve 22. Locking rollers 18 may then yield radially outward, so that tool shank 12 may be removed from chuck 10 or inserted into chuck 10.

Locking sleeve 22 is pre-tensioned in the direction of the locked position by a spring element 24 for this purpose, in order to prevent unintentional unlocking of tool shank 12.

Chuck 10 is operated by an operating sleeve 28 which externally encloses locking sleeve 22 and is axially displaceable, operating sleeve 28 being pre-tensioned in the axial direction by a spring element 30. When operating sleeve 28 is displaced in the direction of locking sleeve 22, operating sleeve 28 strikes against locking sleeve 22, locking sleeve 22 being axially driven.

Furthermore, chuck 10 has an elastic, annular dust lip-type ring 32, which prevents the penetration of dust into insertion opening 16.

In addition, chuck 10 has an arresting mechanism, which arrests locking sleeve 22 in the unlocked position and thus allows one-handed operation when changing the tool.

The arresting mechanism includes, among other things, a steel ball 34, which is mounted so it is radially displaceable in a radially running opening 35 in chuck body 14. Opening 35 in chuck body 14 tapers inward in the radial direction in order to prevent ball 34 from falling out of opening 35 into the inside of insertion opening 16. Ball 34 may thus only partially project inward into insertion opening 16, as shown in FIG. 1.

Furthermore, the arresting mechanism has an arresting pin 36, which is mounted so it is radially displaceable in a radially running hole in locking sleeve 22, arresting pin 36 being pre-tensioned radially inward by an annular spring 38.

Arresting pin 36 is guided in two axially running grooves 40, 42, which are positioned in the lateral surface of chuck body 14 on both sides of opening 35 for ball 34, workpiece-side groove 40 being shallower than tool-side groove 42. In the unlocked position shown in FIG. 1, arresting pin 36 therefore presses axially against the step between both grooves 40, 42, through which locking sleeve 22 is axially arrested.

In the following, it will be described on the basis of FIG. 1 how tool shank 12 is inserted into chuck 10 and then locked automatically.

Before tool shank 12 is inserted, locking sleeve 22 must first be brought into the unlocked position shown in FIG. 1. For this purpose, the user pushes operating sleeve 28 in the direction of locking sleeve 22, locking sleeve 22 being axially driven until arresting pin 36 finally catches behind the step between both grooves 40, 42 and thus axially arrests locking sleeve 22.

Subsequently, the user may release operating sleeve 28, which then travels back to the starting position because of the pre-tension of spring 30.

When tool shank 12 is axially inserted into insertion opening 16, tool shank 12 then presses locking rollers 18 radially outward until locking rollers 18 engage in grooves 20 in tool shank 12.

When tool shank 12 is inserted further, the face of tool shank 12 then presses ball 34 radially outward, arresting pin 36 also being pressed radially outward against the pre-tension of annular spring 38.

When arresting pin 36 is then raised over the step between both grooves 40, 42, spring 24 presses locking sleeve 22 axially into the locked position shown in FIG. 2, arresting pin 36 being guided in groove 40. In the locked position, the inside of locking sleeve 22 then covers the opening for locking rollers 18, which may therefore no longer yield radially outward and thus axially lock tool shank 12 with a predefined movement play.

Tool shank 12 is thus automatically locked when it is inserted into chuck 10, without user intervention being necessary.

In the following, the removal of tool shank 12 from chuck 10 will be described on the basis of FIG. 3.

Before tool shank 12 is removed from chuck 10, locking sleeve 22 must first be brought out of the locked position shown in FIG. 2 into the unlocked position shown in FIG. 3. For this purpose, the user pushes operating sleeve 28 axially out of the position shown in FIG. 1 in the direction of locking sleeve 22, operating sleeve 28 axially driving locking sleeve 22 until arresting pin 36 lies in groove 42 on the tool side behind ball 34 and presses against ball 34 at the same time.

Subsequently, the user releases operating sleeve 28, whereupon operating sleeve 28 returns to its starting position because of the return force of spring 30.

Locking sleeve 22 is then axially arrested by ball 34 and arresting pin 36, since arresting pin 36 presses laterally against ball 34, while ball 34 is pressed axially outward by the lateral surface of tool shank 12. It is to be noted here that groove 20 around the circumference for locking rollers 18 does not include the part in which ball 34 is positioned. Ball 34 may thus not yield inward into groove 20, since this is offset at an angle in relation to ball 34.

The user may then pull tool shank 12 axially out of chuck 10 until tool shank 12 finally releases ball 34, which then yields radially inward. Arresting pin 36 is then no longer blocked by ball 34, so that locking sleeve 22 travels into the locked position shown in FIG. 2 because of the pre-tension of spring 24.

Figure 5:
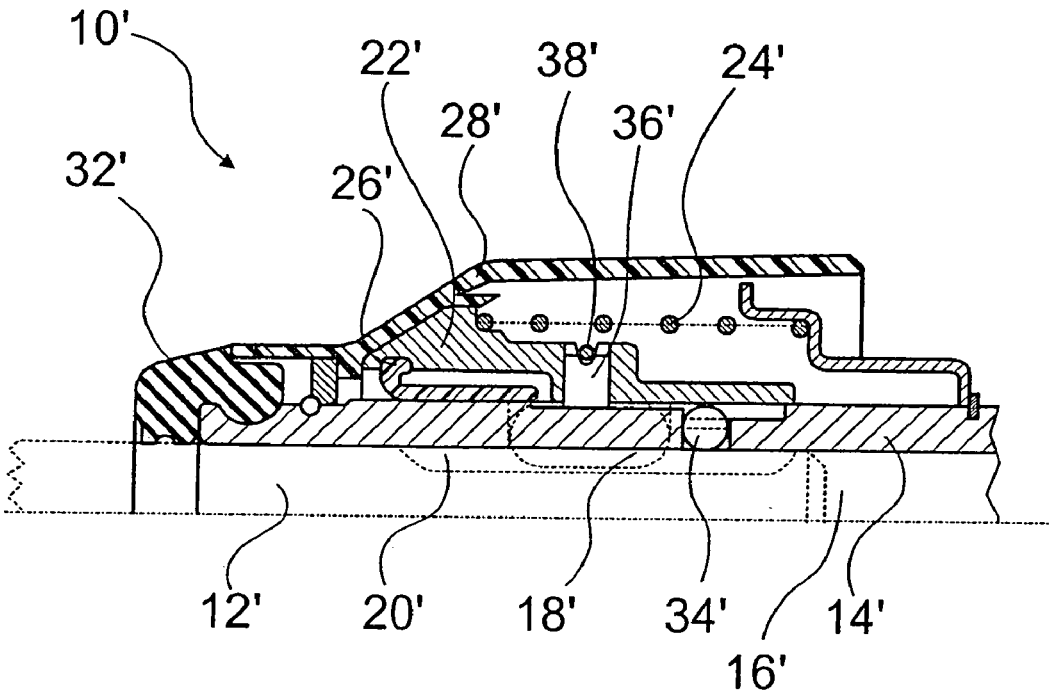
FIG. 5 shows an alternative embodiment of a chuck according to the present invention.

The exemplary embodiment of a chuck 10' according to the present invention shown in FIG. 5 largely corresponds to chuck 10 described above, so that in the following, reference is made to the description above to avoid repetition and the same reference numbers, which are only identified by an apostrophe for differentiation, are used for corresponding components.

The special feature of this exemplary embodiment is that spring 30, provided in FIGS. 1 through 3 to return operating sleeve 28, is dispensed with.

Instead, operating sleeve 28' is permanently connected to locking sleeve 22' in this exemplary embodiment, so that both are displaced together.

The present invention is not restricted to the preferred exemplary embodiments described above. Rather, multiple variations and alterations are possible, which also make use of the ideas according to the present invention and therefore fall within the scope of protection.

LIST OF REFERENCE NUMBERS

10, 10' chuck
12, 12' tool shank
14,14' chuck body
16, 16' insertion opening
18, 18' locking roller
20, 20' groove
22, 22' locking sleeve
24, 24' spring
26, 26' lip-type ring
28, 28' operating sleeve
30 spring
32, 32' dust lip-type ring
34, 34' ball
35 opening
36, 36' arresting pin
38, 38' annular spring
40 groove
42 groove

What is claimed is:

1. A chuck, comprising:

a chuck body having an insertion opening for holding a tool shank;

a locking element for axially locking the tool shank in the insertion opening, the locking element being axially movable between a locked position, a first unlocked position, and a second unlocked position; and an arresting pin mounted in the locking element and radially displaceable between an arresting position and a release position, the arresting pin axially arresting the locking element when the locking element is in the first and second unlocked positions and the arresting pin is in the arresting position, and axially releasing the locking element from the first unlocked position when the arresting pin is in the release position.

2. The chuck as recited in claim 1, wherein the chuck is for one of a hammer drill and a chisel hammer.

3. The chuck as recited in claim 1, further comprising:

a first spring element for pre-tensioning the arresting pin in a direction of the arresting position, the arresting pin pressing against an axial stop in the chuck body in the arresting position.

4. The chuck as recited in claim 3, wherein the arresting pin can be disengaged from the arresting position by the tool shank.

5. The chuck as recited in claim 4, further comprising:

a transmission element mounted in such a way that the transmission element is radially displaceable in the chuck body, wherein:

the transmission element disengages the arresting pin from the arresting position, and the transmission element is displaceable radially outward against the arresting pin by the tool shank.

6. The chuck as recited in claim 5, wherein the transmission element includes a ball.

7. The chuck as recited in claim 5, wherein a side of the arresting pin axially contacts the transmission element when the locking element is arrested in the second unlocked position.

8. The chuck as recited in claim 1, wherein the locking element is sleeve-shaped.

9. The chuck as recited in claim 1, further comprising:

a first spring element for pre-tensioning the locking element axially in a direction of the locked position.

10. The chuck as recited in claim 1, further comprising:

an axially displaceable operating element to axially displace the locking element.

11. The chuck as recited in claim 10, further comprising a first spring element for pre-tensioning the operating element in an axial direction.

12. The chuck as recited in claim 10, wherein the operating element is sleeve-shaped and at least partially encloses the locking element.

13. The chuck as recited in claim 1, further comprising:

radially displaceable locking rollers for engaging in grooves in the tool shank in the locked position of the locking element, the radially displaceable rollers being positioned in the chuck body to axially lock the tool shank.

14. The chuck as recited in claim 1, wherein the chuck is used in a machine tool including one of a hammer drill and a chisel hammer.

15. The chuck as recited in claim 1, wherein the chuck is configured such that removal of the tool shank from the chuck releases the locking element from the second unlocked position.

16. The chuck as recited in claim 15, wherein upon release of the locking element from the second unlocked position, the locking element is configured to axially move from the second unlocked position to the first unlocked position.

17. The chuck as recited in claim 16, wherein the arresting pin is configured to remain in the arresting position as the locking element axially moves from the second unlocked position to the first unlocked position.

18. The chuck as recited in claim 1, wherein the chuck is configured to receive the tool shank when the locking element is in the first unlocked position and to release the tool shank for removal when the locking element is in the second unlocked position.

* * * * *